United States Patent [19]

Bondhus

[11] 3,997,053

[45] Dec. 14, 1976

[54] TOOL HOLDER

[76] Inventor: John R. Bondhus, R.R. No. 2, Monticello, Minn. 55362

[22] Filed: Aug. 18, 1975

[21] Appl. No.: 605,311

[52] U.S. Cl. ..... 206/377

[51] Int. Cl.[2] ..... B65D 85/20

[58] Field of Search ..... 206/377, 372, 379; 211/60 T, 69

[56] References Cited

UNITED STATES PATENTS

| | | | |
|---|---|---|---|
| 2,341,496 | 2/1944 | Zethmayr | 211/69 |
| 2,594,955 | 4/1952 | Markowitz | 211/69 |
| 2,604,211 | 7/1952 | Steine | 211/69 |
| 2,810,472 | 10/1957 | Midkiff | 206/377 |

FOREIGN PATENTS OR APPLICATIONS

| | | | |
|---|---|---|---|
| 878,473 | 9/1961 | United Kingdom | 206/377 |

*Primary Examiner*—William T. Dixson, Jr.
*Attorney, Agent, or Firm*—Frederick E. Lange

[57] ABSTRACT

A tool holder for removably holding a plurality of tools such as hexagonal key wrenches in which the holder has a passage for each tool and in which each passage has, spaced from the end in which the tool is inserted, an inwardly extending projection which allows the tool to pass when a flat side of the tool is parallel to the flat face of the projection but which grips the tool when it is turned to bring a corner edge of the tool into engagement with the flat face to clamp it. With large tools, there are two opposed inwardly extending projections, one of which has a groove into which a corner edge of said tool enters to yieldably retain the tool against rotation from its gripped position. With small tools, the tool holder has a shoulder against which the tool bears to limit the movement of the tool away from its gripped position. Instead of all of the passages being in a row, there are two overlying rows of passages so that the holder is narrower and thicker with the result that it can be conveniently grasped as a handle for one of the tools when that tool is partially withdrawn from the holder.

9 Claims, 7 Drawing Figures

Fig. 1
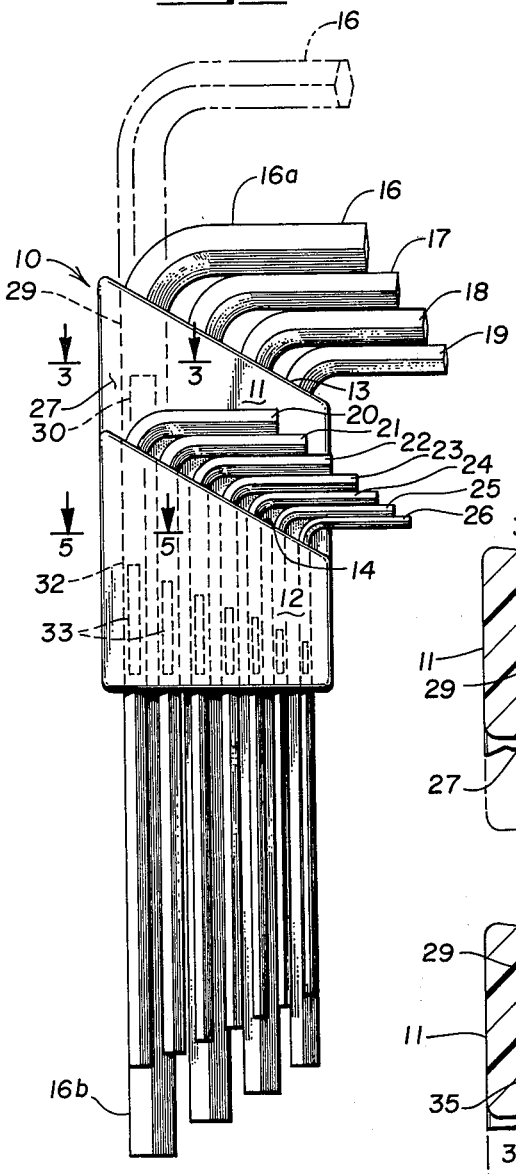
Fig. 2
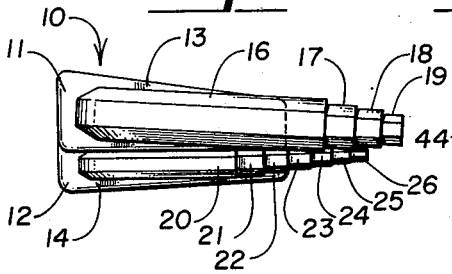
Fig. 7
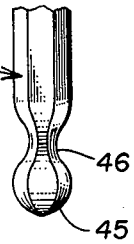
Fig. 3
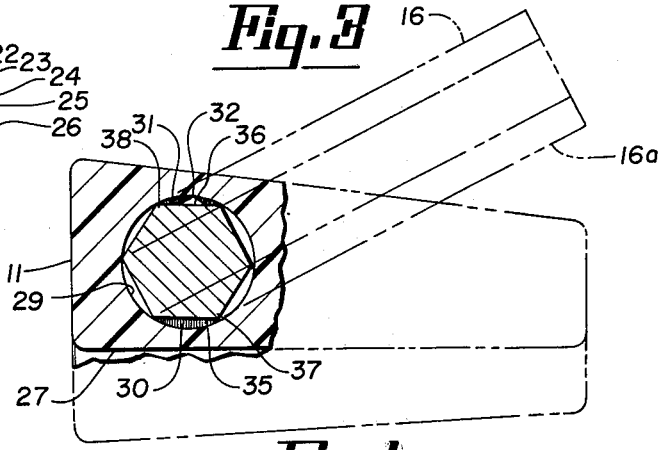
Fig. 4
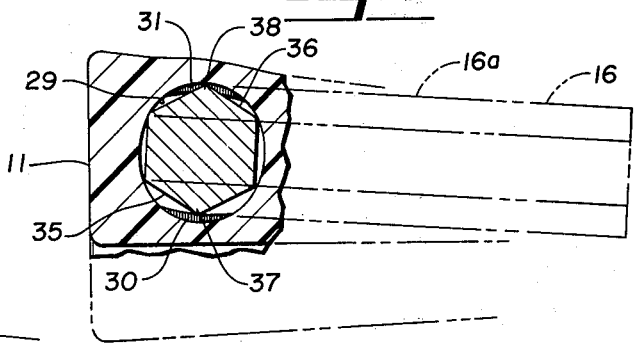
Fig. 6
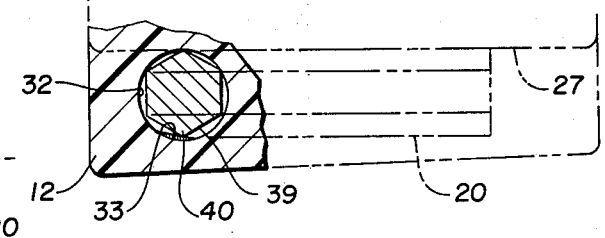
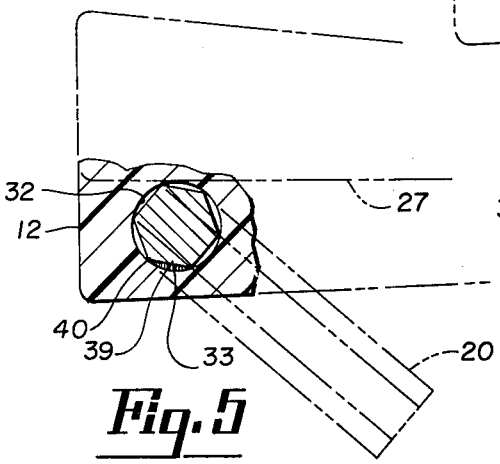
Fig. 5

TOOL HOLDER

BACKGROUND OF THE INVENTION

In tool holders, particularly those for small tools, it is desirable to have some arrangement for retaining the tool in the tool holder against accidental displacement therefrom. If some means is not provided for retaining the tool, the tool is apt to slip out of the tool holder when the holder is placed in a tool box or where it is accidentally dropped. This is particularly bothersome when the tool holder is designed for holding a number of tools.

Various arrangements have been provided for retaining tools within a tool holder. Many of these employ some sort of retaining means which exerts a constant pressure on the tool and prevents it from accidentally being dislodged. Where the tool holder is of the type having a substantial passage for reception of a portion of the tool, this has the drawback that the tool must be forced in past the retaining means. Not only is this inconvenient but the continued insertion and removal of the tools from the tool holder will eventually result in wear of the retaining means so that the retaining means is no longer effective.

SUMMARY OF THE INVENTION

The present invention is concerned with a tool holder in which the tool moves relatively freely within a longitudinal passage within the tool holder until the tool is longitudinally in the desired position. At that time, the tool is rotated about its longitudinal axis and gripped in position against longitudinal withdrawal.

Specifically, I provide for a tool having at least one flat side and an inwardly extending projection having a flat face so spaced from the opposite wall of the passageway that it permits the free insertion of the tool when the flat side thereof is parallel to the flat face of the projection. After the tool is in position, however, when it is rotated, the portion of the tool circumferentially spaced from the flat side is brought into gripping engagement with the flat face of the projection.

Where the tool is a tool of polygonal cross-section, the flat side is one of the flat sides of the polygon. In such case, the flat face of the inwardly projecting portion is spaced from the opposite portion of the passageway by an amount no less than the distance between two opposite flat sides of the polygonal tool.

It is desirable that the inwardly projecting portion be spaced from the end of the passageway into which the tool is inserted. In this way, the tool can be readily moved through the passage until it encounters the projection at which time the tool can still be moved past the projection providing that one flat surface of the tool is parallel to the flat surface of the projection.

Where the tool is a tool of polygonal cross-section of any shape having two opposed relatively flat sides, I may provide two oppositely disposed, inwardly extending projections. In such case, it is desirable to provide one of these projections with a longitudinally extending groove for receiving a corner edge of the tool upon rotation of the tool to the tool retaining position. This groove tends to lock the tool against rotation away from the tool retaining position.

In some cases, particularly where an angular arm of the tool tends to rest against the shoulder of the tool holder when the tool is in its tool retaining position, I may locate the inwardly extending projection in such a position that the engagement of the arm of the tool with the shoulder prevents the tool from turning away from the position in which it is retained in the holder.

One type of tool for which the tool holder is particularly adaptable is the type of wrench in which there is a ball end to permit the engagement of the wrench with the type of screw having a recess of hexagonal cross section. The ball type of arrangement permits engagement of the wrench at an angle where the screw is in a relatively inaccessible location. A tool having such a ball end slides more readily into the holder past the inwardly extending projection because of the curved forward end. After the tool is turned to its normal position in the case, however, it is held securely in position in the manner described above.

A further feature of my tool holder is that I provide two overlapping rows of passages for tools of varying sizes. Often, such tools are disposed in a continuous row with the result that the holder is relatively wide. By overlapping the two rows of tools, however, a relatively narrow thick holder is provided. The advantage of this is that if one of the tools is partially withdrawn, the holder can be employed as a handle for actuation of the tool. The tool holder is also more compact so as to fit more readily into pockets or tool boxes.

Numerous other features and objects of the invention will be apparent from the accompanying specification, claims and drawing.

DESCRIPTION OF THE DRAWING

FIG. 1 is a vertical plan view of my tool holder with a plurality of L-shaped hexagonal key wrenches disposed therein, one of such wrenches being shown in dotted lines as partially withdrawn from the case;

FIG. 2 is a top plan view of the tool holder and tools of FIG. 1;

FIG. 3 is a fragmentary view partly in section taken along the line 3—3 of FIG. 1, with the tool therein shown in the angular position it occupies while being inserted into or removed from the case;

FIG. 4 is a view similar to FIG. 3 but with the tool disposed in the position it normally occupies in the holder, in which position it is retained against ready removal from the case;

FIG. 5 is a fragmentary view partly in section taken along the line 5—5 of FIG. 1, showing one of the tools in the position it occupies while being inserted into or removed from the case;

FIG. 6 is a view similar to FIG. 5 but showing the tool in the position it occupies when locked in the case; and FIG. 7 is a view of a portion of a modified form of L-wrench suitable for use in the tool holder.

DESCRIPTION OF THE PREFERRED EMBODIMENTS

In FIG. 1, I have shown my improved tool holder as containing a number of L-shaped hexagonal key wrenches. The tool holder is generally designated by the reference numeral 10 and contains two integral tool holding portions 11 and 12. Each of these is provided with a plurality of longitudinal passages for reception of the longitudinal portions of the tools which are designated by the reference numerals 16 through 26. The portion 11 has an upper inclined top wall 13 and, as will be noted, the tools 16 through 19 extend through apertures, the upper ends of which terminate at the wall 13. Because of the top wall 13 being inclined, it is possible for the short horizontal parts of the tools 16 through 19 to be disposed in overlapping relationship with each other to result in a compact arrangement. The tools or wrenches 16 through 19 are, as will be readily apparent, the larger size tools.

The portion 12 of the holder 10 likewise has an inclined top wall 14 which is parallel to the wall 13 of the portion 11 but is substantially lower than the upper wall 13 of the portion 11. This is due to the fact that the portion 12 for receiving the wrenches 20 through 26 does not have to have as large a vertical dimension as the portion 11. This is because the longitudinal parts of the wrenches 20 through 26 will be much shorter than that of the corresponding parts of wrenches 16 through 19. The fact that the upper wall 14 of portion 12 is lower than the upper wall 13 of portion 11 results in the flat wall 27 of the upper portion 11 extending above the inclined upper surface 14 of portion 12. This wall portion 27 forms a shoulder against which the horizontal portions of wrenches 20 through 26 rest when they are locked in the tool holder as will be presently described. Furthermore, this wall 27 functions, as will be explained, in retaining these wrenches or tools 20 through 26 in their gripped or locked position.

As previously explained, each of the tools 16 through 26 has a short horizontal portion and a long vertical or longitudinal portion. In connection with wrench 16, I have indicated these two portions by the reference numerals 16*a* and 16*b*, respectively. In other words, the portion 16*a* is a relatively short portion which, when in the holder and when the holder is positioned vertically, as in FIG. 1, is disposed horizontally wheras the portion 16*b* extends vertically and constitutes a longitudinal part of the tool. While the tool holder is particularly adaptable for use with tools of this type, it is to be understood, of course, that it is not so limited and that other types of tools could be retained in the tool holder, as will be presently described.

The holder 10 is provided with a plurality of passages each of a size corresponding to one of the tools. In the example shown, each passage extends through the bottom of the holder. As has been previously explained, the tools 16 through 26 are graduated in size, tool 16 being the largest and tool 26 being the smallest. In the particular example shown, where the tools are L-wrenches, the tools are all of hexagonal cross section. The passages for reception of the tools are preferably all of a diameter slightly exceeding the distance between two opposite apexes of the diagonal cross section of the tool so that the tool can freely slide through the passage. In portion 11, there are a plurality of passages 29. Only one of these is visible in dotted lines in FIG. 1. One of these passages 29 is likewise shown in FIGS. 3 and 4. It will be understood that the similar passages 29, however, are all of the same general configuration but are of gradually decreasing diameter to correspond with the decreasing cross sectional area of the longitudinal parts of tools 16 through 19.

The portion 12 is similarly provided with a plurality of passages 32. One of these passages 32 is shown in dotted lines in FIG. 1 and is shown in full lines in FIGS. 5 and 6 in connection with the tool 20. It is to be understood, of course, that the remaining passages 32 are all of the same general configuration but are of progressively decreasing diameter to correspond to the progressively decreasing cross section areas of the tools 20 through 26. In all cases, as pointed out above, and as is evident from FIGS. 3 through 6, the diameter of each of the passages 29 and 32 is chosen so that the diameter is at least equal to if not slightly greater than the distance between the opposite corners of the polygonal cross section of the tool. Thus, as far as the passages 29 and 32 are concerned, the wrench or tool can move freely through the opening for which it is designed without any restriction. The drawback to the structure described so far, of course, is that the tools can also drop out of the openings readily if the tool holder is turned 180° with respect to the position shown in FIG. 1. Even where the tool holder is disposed so that the longitudinal parts of the tools 16 through 26 are horizontally disposed rather than vertically disposed as shown in the drawing, the tools can gradually work loose from the holder. This is particularly true if the holder is carried in a tool box where it is subject to considerable vibration. The present invention is specifically concerned with a means for preventing the tools from accidentally dropping or being shaken out of the holder. This means will now be described.

Reference will now be made to FIGS. 3 and 4. It will be noticed that there are two inwardly extending projections 30 and 31 of segmental cross section. As will be noted in FIG. 1, the projection 30 starts from a point somewhat below the upper end of the holder 10. Or, in other words, each inwardly extending projection 30 terminates at its upper end somewhat below the inclined upper wall 13 of the portion 11. Inwardly extending projections 30 extend downwardly until close to the bottom of the holder. It is to be understood that the projections 31 may be of the same vertical length. The length of these projections is not, however, critical and they could extend the full vertical length of the holder or be relatively short in length. The inwardly extending projection 31 has a longitudinal groove 32 of triangular cross section running the full length thereof. The function of this groove will be explained later. Each of the inwardly extending projections 30 and 31 has a relatively flat face which in cross section is defined by the chord of the segmental cross section. The width of this face or the length of the chord corresponds approximately to the width of one of the flat faces of the tool. If desired, the projection may be somewhat smaller so that the chord does not subtend quite as large an arc as that existing between two adjacent corners of the tool.

As is clearly apparent from FIG. 3, the distance between the flat faces of inwardly extending projections 30 and 31 is subtantially as great as the distance between the opposite flat walls of the tool inserted in the opening in which the projections are located. In other words, in the specific structure shown in FIGS. 3 and 4, the distance between the flat faces of projections 30 and 31 is equal to or greater than the distance between the opposite sides 35 and 36 of the longitudinal part 16*b* of the tool 16. At the same time, these opposite flat sides are spaced by a distance less than that between opposite corners of the tool. In other words, the distance between the flat sides of the projections 30 and 31 is substantially less than the distance between the two opposite corners 37 and 38 of the tool 16. Thus, if the tool 16 is turned, as shown in FIG. 3, so that the opposite sides 35 and 36 thereof are parallel to the flat faces of the inwardly extending projections 30 and 31, it is possible to freely pass the tool between the projections 30 and 31 to the vertical position shown in FIG. 1. As is shown in dotted lines in FIG. 3, this involves the horizontal or short portion 16*a* of the tool being rotated at an angle to the plane of the wall 27 of the portion 11 of the holder. When the tool 16 is in the desired vertical position shown in FIG. 1, it is then rotated in a clockwise direction (as viewed in FIG. 3) to bring it to the position shown in FIG. 4. This involves moving the angular edges 37 and 38 on to the flat surfaces of projections 30 and 31. This is possible because the material of which the tool holder is formed is slightly yieldable. I have found it desirable to employ an oil resistant low density polyethylene material for forming the tool holder. This material tends to be resiliently yieldable. It will furthermore be noted from FIG. 3 that the walls of the holder adjacent the projections 30 and 31 are somewhat thinner than some of the other walls. The result is that the wall can flex slightly as the angular projections 37 and 38 are being moved on to the flat surfaces of projections 30 and 31. When the tool 16 is rotated until the short horizontal part 16*a* of the tool is in the position shown in FIGS. 2 and 4, the angular edge 38 of the tool will enter the triangular slot 32 locking the tool in the angular position shown in FIGS. 2 and 4. This tends to prevent the tool being accidentally rotated back to the position shown in FIG. 3 in which position the tool is free to be withdrawn from the holder. In order to withdraw the tool from the holder, it is necessary to exert sufficient force on the tool to move the angular edge 38 out of the triangular notch 32 back to the position shown in FIG. 3.

The arrangement of the present invention permits the tool to be readily inserted into the holder and moved to the desired vertical position therein. After it is in the desired position, it is readily locked in position by rotating the tool to the desired position in the tool holder in which the short horizontal portion of the tool is generally parallel to the vertical center plane of the holder. Because the tool is in gripping engagement with the inwardly extending projections only after it is in position and does not need to be forced past these projections for the full length of the travel of the tool into the holder, there is relatively little wear of the projections as compared with arrangements in which there are retaining means which exert a constant pressure on the tool for the full length of its travel into the tool holder. Furthermore, it is relatively easy to insert or remove a particular tool. All that it is necessary to do is to turn the tool angularly until the two opposite faces thereof are parallel to the flat surfaces of the inwardly extending projections. The tool can then be readily moved into or out of the holder.

The arrangement employing two inwardly extending projections diametrically opposed to each other, one of which has a notch in it, is very effective in retaining the tools in position. When, however, the openings are somewhat smaller, it is very difficult from a practical standpoint to have two such opposed projections, one with a longitudinal notch in it. The length of the chords of the segmental cross sections becomes so small that it is very difficult to provide such a notch and have the depth of it sufficient to provide any holding action. Accordingly, in connection with the openings 32 in this portion 12 of the holder, I provide a slightly different arrangement. Here, there is only one inwardly extending projection 33 for each passage, and the flat face of this projection is disposed at a slight angle with respect to the plane of wall 27. In other words, it is disposed so that it is parallel to a flat side 39 of the longitudinal part of tool 20 when the tool 20 is disposed in the angular position shown in FIG. 5. The distance between the flat surface of projection 33 and the opposite portion of the opening 32 as measured by the distance to a chord the same length as the width of the flat face of projection 33 is equal to or greater than the distance between the side 39 and the diametrically opposite side of the tool. Thus, the tool 20 when in the angular position shown in FIG. 5 can be moved down through the opening 32 with relative little obstruction. As is clearly evident from FIG. 1, the inwardly extending projections 33 only extend part way up to the inclined upper wall 14 of portion 12 of the tool holder. Thus, initially, the tool encounters no resistance whatsoever regardless of its angular position. As soon, however, as the lower end of the tool engages the inwardly extending projection, it must be rotated angularly until the face 39 thereof is parallel to the flat face of the inwardly extending projection 33. Thereafter, the tool can be moved vertically to the desired position. The horizontal short portion of the tool is now rotated counter clockwise (as viewed in FIG. 5), to bring this short portion against the shoulder 27, as shown in FIG. 6. In doing so, the angular corner 40 of the tool is moved over the flat surface of the inwardly extending projection 33 past its midpoint. Hence, the engagement of this angular corner with the flat face of the projection 33 tends to resist any clockwise rotation back to the position shown in FIG. 5 since to do so means that the corner 40 has to move back past the center point of the flat surface of the projection 33 at which point the resistance to movement is the greatest. At the same time, because of the engagement of the horizontal portion of the tool 20 with the wall 27, as probably best shown in FIGS. 2 and 6, the tool cannot continue to rotate in a counter clockwise direction. Hence, the tool tends to be retained in the position shown in FIGS. 2 and 6, in which position it is gripped by the engagement of corner 40 with the inwardly extending projection 33. Again, as with the form shown in FIGS. 3 and 4, the wall adjacent the inwardly extending projection 33 is slightly thinner than some of the other wall material, for example, the wall immediately to the left of the opening 32 (as viewed in FIGS. 5 and 6). Hence, the material of the holder tends to flex slightly as the corner 40 of the tool is moved over the flat surface of inwardly extending projection 33.

In FIG. 1, I have shown the lower ends of the wrenches as relatively flat. The tool holder of the present invention is particularly adapted for use with tools in which the tool terminates in a ball end. Such an arrangement is shown in FIG. 7 in connection with a tool which has been indicated by the reference numeral 44. In this case, there is a lower ball end 45 which is joined to the main portion of tool 44 by a neck 46 and which has arcuate sides which form a continuation of the flat sides of the main portion of the tool. The tool 44 is very desirable in making it possible to insert the tool at an angle into the female opening of a typical hexagonal socket screw. The ball portion 45 furthermore facilitates the insertion of the tool into the tool holder of the present invention since the ball tends to guide the tool into the upper end of the longitudinal passage through the tool holder. Furthermore, when the tool encounters the inwardly extending locking projection, the ball shaped end 45 facilitates guiding the tool to the right angular position for passage through the space between the inwardly extending projection and the opposite wall of the passage.

It will be noted in FIG. 1, that I have shown the wrench 16 as being withdrawn partially. It is possible to withdraw any of the wrenches sufficiently to enable them to be used in connection with the screw or other device to be actuated. The wrench may even be turned back into a position in which it is locked while it is being used. Where the wrench is not entirely withdrawn from the tool holder, the tool holder can then function as a handle for manipulation of the wrench. An important feature of the present invention is that because there are two parallel rows of passages for retaining the wrenches, the wrench holder can be much narrower and is somewhat thicker than where all of the wrenches are disposed along a single center plane. In such case, the holder tends to be relatively wide and thin and cannot be gripped readily as a handle. With the arrngement of the present invention in which the passages 29 and 32 are parallel and overlying each other, the holder is much narrower and results in a shape more suitable for use as a handle.

I have described the invention particularly in connection with tools of hexagonal cross section, such as an L-wrench. It is to be understood, however, that the tool holder is also applicable to any type of tool in which the tool has at least one flat surface extending over a longitudinal part thereof. In such case, all that it is necessary to do is to line up the one flat surface of the tool with the flat surface of the inwardly extending projection and insert the tool to the desired depth. After that, the tool can be rotated and the result will be that the tool will be clamped in position.

While I have shown a specific embodiment of my invention for purposes of illustration, it is to be understood that the scope of the invention is to be limited solely by that of the appended claims.

I claim as my invention:

1. In combination, a tool holder and a plurality of tools, each of which has a longitudinal part which has at least one flat side, said tool holder being formed of resiliently yieldable material and having a plurality of longitudinal passages therein, each of a cross sectional configuration receiving freely the longitudinal part of one of the tools, each of said passages having an inwardly projection portion having a flat inner face spaced from the opposite portion of said passage by a distance substantially as great as the distance between said flat side of the longitudinal part and the opposite portion of the tool therein but less than the distance between other opposite portions of said tool part a first of which opposite portions is adjacent said flat side so that said flat side thereof is parallel to and adjacent the flat inner face of said projecting portion, said tool can be passed through said passage past said inwardly projecting portion but when said tool is rotated about its longitudinal axis after insertion into said passage, said first of said opposite portions of the longitudinal part of said tool is moved into gripping relation with said flat inner face to retain the tool in position.

2. The combination of claim 1 in which the longitudinal parts of at least some of said tools each have two opposite flat sides and in which the longitudinal passages of the tool holder receiving such tools each have two opposite inwardly projecting portions each with a flat inner face and with said flat inner faces spaced apart a distance substantially as great as the distance between the opposite flat sides of the tool in the passage.

3. The combination of claim 2 in which the longitudinal parts of such tools are of polygonal cross-section and in which one of said flat inner faces of said inwardly projecting portions in each passage receiving such a tool has a groove therein for receiving a corner edge of said tool upon rotation of the tool to the tool retaining position.

4. The combination of claim 1 in which the tools are each provided with a further part extending at an angle to said longitudinal part and said tool holder is provided with a shoulder portion against which the further parts of some of the tools rest when said tools have been rotated into gripping rotation with said flat inner faces of said inwardly projecting portions.

5. The combination of claim 1 in which the inwardly projecting portion in each of said passages is spaced from the end of the passage into which the tool is initially inserted so that the tool initially slides freely in the passage.

6. The combination of claim 1 in which the wall portions of the holder adjacent the portion of the passages in which said inwardly projecting portions are located is not as thick as other wall portions of said holder so that when said tools are moved into gripping relation with said flat inner faces the wall portions adjacent thereto flex slightly.

7. The combination of claim 1 in which the passages are of different cross-sectional areas and in which the tools disposed therein have longitudinal parts of different cross-sectional areas corresponding to the cross-sectional areas of said passages.

8. The combination of claim 1 in which the tool holder is formed with a plurality of overlying rows of passages and in which the tool holder is sufficiently thick to provide for such a plurality of rows of passages with adequate wall portion therearound, of a width not substantially greater than required by the cross-sectional area of the passages and the necessary wall portion therearound, and of a length substantially greater than the width so that said tool holder is sufficiently narrow and long to be conveniently grasped as a handle for one of said tools when said tool is in a position in which it can engage a device to be actuated.

9. The combination of claim 1 in which the tools are hexagonal key wrenches.

* * * * *

UNITED STATES PATENT OFFICE

CERTIFICATE OF CORRECTION

Patent No. 3,997,053 Dated Dec. 14, 1976

Inventor(s) John R. Bondhus

It is certified that error appears in the above-identified patent and that said Letters Patent are hereby corrected as shown below:

Column 7, line 42, "projection" should be--projecting--.
Column 7, line 49, (Claim 1, line 15) after "that" insert --when said tool is turned so that--.

Signed and Sealed this

*Twenty-first* Day of *September 1982*

[SEAL]

*Attest:*

GERALD J. MOSSINGHOFF

*Attesting Officer*

*Commissioner of Patents and Trademarks*